United States Patent [19]

Ignasiak

[11] Patent Number: 4,726,810

[45] Date of Patent: Feb. 23, 1988

[54] PROCESS FOR THE SELECTIVE AGGLOMERATION OF SUB-BITUMINOUS COAL FINES

[75] Inventor: Boleslaw Ignasiak, Edmonton, Canada

[73] Assignee: Her Majesty the Queen in right of the Province of Alberta as represented by the Minister of Energy and Natural Resources, Edmonton, Canada

[21] Appl. No.: 628,710

[22] Filed: Jul. 9, 1984

[30] Foreign Application Priority Data

May 23, 1984 [CA] Canada ..... 454978

[51] Int. Cl.[4] ..... C10L 1/32

[52] U.S. Cl. ..... 44/51; 44/56; 44/57; 44/61; 44/23; 44/24

[58] Field of Search ..... 44/51, 61, 56, 57, 23, 44/24; 406/47, 49, 197

[56] References Cited

U.S. PATENT DOCUMENTS

| | | | |
|---|---|---|---|
| 3,957,456 | 5/1976 | Verschuur | 44/6 |
| 4,153,419 | 5/1979 | Clayfield et al. | 44/24 |
| 4,209,301 | 6/1980 | Nicol et al. | 44/24 |
| 4,217,110 | 8/1980 | Verschuur | 44/51 |
| 4,448,585 | 5/1984 | Yoo | 44/51 |

FOREIGN PATENT DOCUMENTS

| | | | |
|---|---|---|---|
| 0029712 | 6/1981 | European Pat. Off. | 44/51 |
| 58-127792 | 7/1983 | Japan | 44/51 |
| 0228862 | 2/1926 | United Kingdom | 44/24 |

*Primary Examiner*—William R. Dixon, Jr.
*Assistant Examiner*—Margaret B. Medley
*Attorney, Agent, or Firm*—Millen & White

[57] ABSTRACT

The process involves adding a low quality oil to an aqueous slurry of sub-bituminous coal particles to act as a selective agglomerating agent. When the mixture is agitated, as by pumping it through a pipeline loop, the coal particles agglomerate and may later be separated from the minerals by screening. The low quality oil used is selected from the group consisting of bitumen, heavy oil, and emulsions thereof. In a preferred aspect, a light hydrocarbon diluent, selected from the group consisting of kerosene, naphtha, and diesel oil, is added to improve the agglomeration results.

4 Claims, 1 Drawing Figure

PROCESS FOR THE SELECTIVE AGGLOMERATION OF SUB-BITUMINOUS COAL FINES

BACKGROUND OF THE INVENTION

1. Field of the Invention

The present invention relates to a process for the selective agglomeration of sub-bituminous coal fines.

Coal fines, usually occurring as aqueous slurries, are an unavoidable product of conventional coal mining processes and may constitute up to 30% of the mined coal. Such fines normally comprise a mixture of coal-rich and inorganic (mineral matter-rich) particles.

Selective agglomeration methods, which rely on the hydrophobic properties exhibited by coal, may be applied to preferentially collect and agglomerate the coal-rich particles in an oil phase. The coal-rich particles become wetted with an oil layer and adhere to form agglomerates. The hydrophilic inorganic (mineral matter-rich) particles remain unagglomerated and suspended in the aqueous phase. Thus, selective agglomeration involves the addition and dispersion of an immiscible agglomeration agent to the aqueous slurry. Exemplary agglomeration agents would exhibit coal-wetting properties and include hydrocarbon oils or the like. The non-hydrophobic matter is separated from the formed agglomerates by mechanical separation techniques such as screening.

2. Prior Art

The selective agglomeration of bituminous high rank coal fines utilizing high quality oil is well documented, as shown, for example in the teachings of U.S. Pat. Nos. 4,209,301 and 4,153,419. Bituminous high rank coal is generally defined as coal of low oxygen content, (3–14%) and having a carbon content ranging from 79–92%. By high quality oil is meant a low viscosity oil, of low contaminant and low heteroatom content. Chemical affinity permits wetting of the high rank coal surface by the high quality oil to thereby form mechanically strong coal agglomerates.

However, agglomeration of high rank coal utilizing low quality oil, that is oil having a high heteroatom content, results in poor selectivity of the agglomeration process (the concentration of mineral matter in the agglomerates is quite high).

Further, unlike high rank coal, low rank sub-bituminous coals do not form mechanically stable agglomerates, but rather low strength flocs, when high quality distillable oil is utilized as the agglomeration agent. Low rank coals are defined as coals having a carbon content ranging from 78–74%, and a relatively high oxygen content (16–25%).

The characteristics of high rank bituminous and sub-bituminous coals are defined as follows.

| | High Rank Bituminous | Sub-Bituminous |
|---|---|---|
| % Moisture | 1–10 | 10–30 |
| % Ash (dry) | 3–50 | 12–40 |
| % VM (daf) | 7–38 | >38 |
| % Fixed Carbon (daf) | 93–62 | <62 |
| % $O_{COOH}$ | below 1% | 1–10% |
| % C (daf) | 79–92 | 74–78 |
| % H (daf) | 4–6.5 | 3.5–5.5 |
| % O (daf) | 3–14 | 16–25 |

The characteristics of the high and low quality oils mentioned can be defined as follows.

| | High Quality Oils | Low Quality Oils |
|---|---|---|
| Specif. Gravity (20° C.) | 0.8000–0.8500 | 0.9000–1.1000 |
| Sulfur (%) | below 0.05 | below 5.0 |
| Total Solids (mg/l) | ≅1 | 1–15 |
| Viscosity (CSt at 40° C.) | 1–2 | 3–500 |
| Distillation | 100% distillable | marginally distillable |

SUMMARY OF THE INVENTION

In accordance with the present invention, there is provided a process for selectively agglomerating low rank sub-bituminous coal particles utilizing an agglomeration agent having low quality oil contained therein, to form stable coal agglomerates.

The process comprises adding an agglomeration agent to an aqueous slurry of the coal particles, agitating the mixture to cause selective agglomeration of the coal-rich particles and, upon reaching equilibrium, mechanically separating the formed agglomerates from the mixture.

The agglomeration agent comprises a bridging liquid, preferably having a diluent additive therein. The bridging liquid is a poor quality oil and is selected from the group consisting of:

(a) bitumen
(b) heavy oil
(c) bitumen emulsion and (d) heavy oil emulsion.

The diluent additive, which is selectively matched to the bridging liquid, comprises a light hydrocarbon selected from the group consisting of:

(a) kerosene
(b) naphtha and (c) diesel oil.

Broadly stated, the invention is a process for selectively agglomerating coal particles in an aqueous slurry to preferentially collect and agglomerate the coal-rich particles therein and separate the inorganic mineral materials therefrom, which comprises: providing an aqueous slurry containing low rank sub-bituminous coal particles; adding an agglomeration agent to the slurry, said agent comprising a bridging liquid and a diluent for said bridging liquid, said bridging liquid being selected from the group consisting of bitumen, heavy oil, and emulsions thereof, said diluent being a light hydrocarbon, the amount of said bridging liquid plus diluent being in the range of 10 to 20% weight to dry ash-free coal weight, the ratio of bridging liquid to diluent being in the range 0.50 to 0.98; and agitating the mixture to form agglomerates of the sub-bituminous coal particles, said agglomerates having a compressive strength in excess of 150 kPa as defined in Table I.

DETAILED DESCRIPTION OF THE INVENTION

Figure 1:
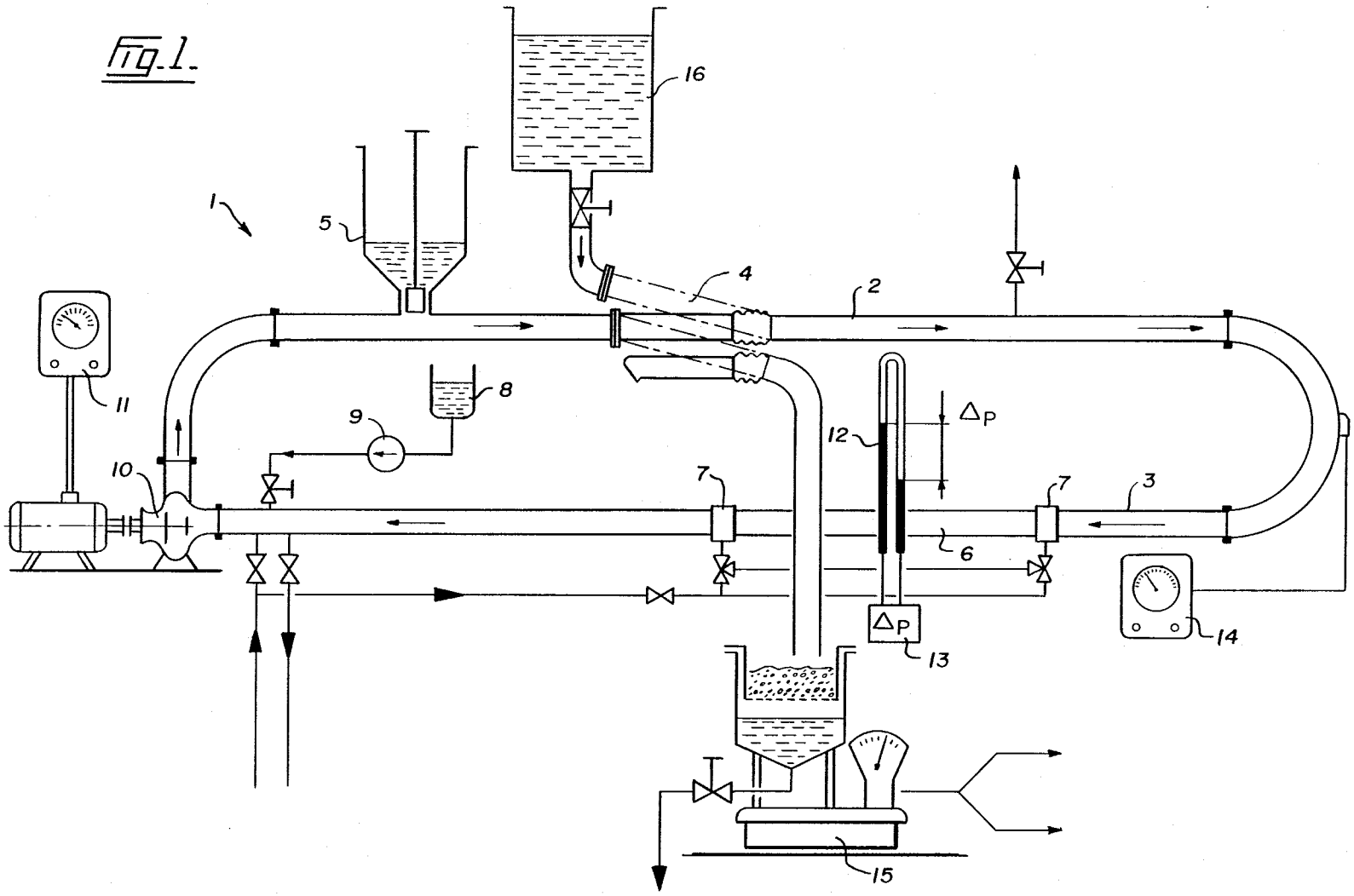
FIG. 1 illustrates the experimental pipeline-loop reactor utilized in the process of the present invention.

The coal feedstock employed in the present process consists of low rank sub-bituminous coal fines in an aqueous slurry. The carbon content of these coals ranges between 78% to 74%. The moisture content of the coal fines feedstock ranges from air dry to 30% water content. The solids concentration of fines to water was found to effect the kinetics of the agglomeration process and the size of the agglomerates formed. The preferred solids concentration would be in the range of about 28%–34% fines to water. The particle size of the feed coal and the particle size distribution influence the final diameter of the formed agglomerates. The particle size diameters would be below about 2 mm and preferably would be from about 0.01 to 0.2 mm.

Typically, the desired mass of coal feed is initially mixed with an amount of water to make up the required solids concentration. A suitable amount of agglomeration agent is then added to the resultant slurry.

The agglomeration agent comprises a bridging liquid containing low quality oil therein. As a preferred aspect, a diluent additive may be combined with the bridging liquid to form the agglomeration agent. The amount of agglomeration agent required is dependent upon the available wetting surface of the coal particles. Generally, an increase in the median diameter of the feed coal particles results in a reduced demand for the agglomeration agent. At a constant agglomeration agent addition level, the agglomerates formed reach different diameters depending upon the median diameter of the feed coal particles. Increasing the concentration of the agglomeration agent results in systematic growth of the formed agglomerates. However, the physical properties of the agglomerates depend upon the concentrations of agglomeration agent added. Low concentrations produce flocculated material, intermediate concentrations yield micro-agglomerates and higher concentrations result in a coal-oil amalgam. Thus, the amount of agglomeration agent added to the slurry is in the preferred range of 10–20% weight to dry, ash-free coal weight.

Addition of the agglomeration agent to the aqueous fines is preferably conducted in a step wise manner, so as to effect gradual selective agglomeration of the coal-rich particles. The agglomeration process may be undertaken continuously utilizing, for example, a pipeline, or batchwise in stirred tanks. The requisite intensity and duration of agitation are determined experimentally and vary with the nature and concentration of the agglomeration agent, characteristics of the coal and the solids concentration.

The bridging liquid consists of oil sand bitumen (5.5–10°API), heavy oil (10.0 to 20°API), a bitumen emulsion, or a heavy oil emulsion. Bitumen and heavy oil are generally both considered low quality oils, having a high heteroatom content and a high contaminant content. While the relationship between the chemical structure of the bridging liquids and their agglomeration properties was not fully investigated, it was found that more viscous bridging liquids yielded relatively larger agglomerates without diminishing the ability to selectively reject ash.

A diluent may be added to the bridging liquid, to lower the viscosity thereof. A diluent is usually employed when bitumen and heavy oil comprise the bridging liquid. The diluent additive preferably consists of light hydrocarbons, most preferably kerosene, diesel oil, or naphtha. The preferred ratio of bridging liquid to diluent is in the range of about 0.50 to 0.98 and preferably about 0.80. When the bridging liquid is selected from bitumen emulsion or heavy oil emulsion, addition of the light hydrocarbon diluent is usually not required.

The time required to reach agglomeration equilibrium varies in accordance with several factors, namely reactor type, agglomeration agent concentration, agitation, and coal type. Without being bound by the same, the time required for completion of agglomerate growth increase with increasing agglomeration agent concentration. Additionally, the time required to form the agglomerates may be shortened when coal particles having larger diameters are utilized.

Agglomerate growth proceeds until a particular agglomerate size is attained. Agglomerate size is dependent upon coal composition, agglomeration agent composition and agitation intensity. By suitable selection of the agglomeration agent concentration and the particle size of the coal feed, the size of the formed agglomerates may be controlled. The particulate diameters of the formed agglomerates would usually, however, be in the range of 0.6 to 10.0 mm.

The ash-content of the agglomerates normally ranges between 6–12% by weight depending upon the mineral matter concentration in the feed-coal.

The mechanical strength and stability of the subbituminous coal agglomerates of the process is found to increase with prolonged exposure to the atmosphere.

EXPERIMENTAL

EXAMPLE I

Batchwise agglomeration tests were conducted in a pair of stirred tanks having the dimensions 2.0 $dcm^2$ and 15 $dcm^2$ respectively. In the smaller vessel, agitation was supplied by a centrally disposed 4-bladed flat turbine of radius 45 mm. The turbine was positioned a distance of 10 mm from the base of the vessel. The larger tank was likewise provided with conventional commercial agitation means. To the agitated suspension of coal in water (the coal concentration being 28–32% on dry matter) a known amount (10–20 weight % on daf coal) of agglomerating agent was added in a dropwise manner over a period of 1–20 minutes. The stirring was continued for period of time ranging from a few minutes up to 10 hours. After completion of the agglomeration process, the agglomerates were separated from the water effluent by conventional screening methods. Results obtained are tabulated in Table I.

EXAMPLE II

Agglomeration tests were carried out in a pipeline-loop reactor as illustrated in FIG. 1. The experimental loop 1 was of the closed circuit type, having a slurry recirculating through the entire system. The pipeline dimensions were as follows: internal diameter 52.0 mm; total pipe length 22 m and loop capacity 46.37L.

The loop 1 comprises an upper acrylic pipe 2 and a lower metal pipe 3. The upper pipe 2 is provided with a flow-switch mechanism 4, positioned proximal the loading/mixing tank 5. The lower metal pipe 3 incorporates a 2.7 m measurement section 6 having pressure tap chambers 7. An oil tank 8 supplies via oil pump 9 the amount of agglomeration agent required into pipe 3. A centrifugal pump 10 having variable speed drive 11 is operative to pump the slurry around the pipeline loop. The pressure drop measurements across measurement section 6 are obtained utilizing a U-tube manometer 12 and differential pressure transducer 13, connected in a parallel manner to pressure tap chambers 7 positioned at each of the test section 6. A standard ultrasonic flow meter 14 is utilized to measure the mean pipeline velocity and to thereby provide an indication of flow rate.

The agglomeration tests were conducted by initially preparing the suspension of coal in water (the coal concentration being 28–32% on dry matter) in loading-/mixing tank 5. The suspension was then charged into upper pipe 2 and circulated in the pipeline for approximately 30 minutes. The requisite amount of agglomeration agent (10–20% weight of daf coal) was introduced into lower pipe 3 from oil tank 8. The pipeline contents were subsequently pumped for varying time periods ranging from a few hours to up to 500 hours to effect agglomeration. After completion of each test, the slurry was discharged into a weigh vessel 15. A water tank 16, connected to the flow-switch mechanism 4 is incorporated into the system for calibrational and convenience purposes.

There was a direct correlation between the agglomeration results attained in the batch and pipeline tests. The results in Table I were obtained using the two test circuits.

The agglomeration tests were conducted utilizing high rank Grande Cache coal, and low rank sub-bituminous Battle River coal. The high quality oils utilized comprised kerosene and diesel oil. The low quality oils included emulsified heavy oils and bitumen blends. The results obtained are detailed in Table I given hereinafter.

TABLE I

RESULTS OF STIRRED TANK AND PIPELINE AGGLOMERATION TESTS CARRIED OUT WITH HIGH RANK GRANDE CACHE AND LOW RANK SUB-BITUMINOUS BATTLE RIVER COALS

| Coal Type | Agglomerating Agent | Agglomerating Agent Concentration[1] | Diluent | Agglomerates Compressive Strength[2] | Size of Agglomerates (mm) | Agglomerates Ash Content (air dry basis) | Agglomerates Oil Content (air dry basis) | Agglomerate Calorific Value[3] |
|---|---|---|---|---|---|---|---|---|
| Grande Cache[4] (high rank mvb coal) | Bitumen + kerosene (4:1 ratio) | 12.6% | yes (20%) | 70 | 1–3 | 9.4% | 10.9% | n/a |
| | kerosene | 10.5% | 100% | 40 | 1–5 | 5.8% | 9.8% | n/a |
| | Emulsified Heavy Oil | 13.2% | no | agglomeration did not proceed | — | — | — | — |
| Battle River[5] (sub-bituminous coal) | Kerosene | 10.5–19.6% | 100% | agglomeration did not proceed | — | — | — | — |
| | Diesel Oil | 9–18.1% | 100% | agglomeration yielded some microagglomerates; not suitable for measurement | — | — | — | — |
| | Emulsified Heavy Oil | 18.2% | no | microagglomerates were generated; not suitable for measurements | ≅0.7 | 11.8 | 14.8 | 11,050 |
| | Bitumen + Kerosene (4:1 ratio) | 18.5% | yes (20%) | 400 | 1–10 | 8.2 | 14.0 | 11,420 |
| | Bitumen + kerosene (4:1 ratio) | 17.9 | yes (20%) | 350 | 1–5 | 9.3 | 13.2 | 11,210 |
| | Bitumen + Naphtha (4:1 ratio) | 19.8 | yes (20%) | 200 | 1–3 | 9.7 | 13.9 | 10,980 |
| | Heavy Oil + Diesel Oil (4:1 ratio) | 20.2 | yes (20%) | 150 | 1–3 | 10.8 | 15.2 | 10,950 |

[1]Concentration expressed in weight % on daf coal.
[2]Compressive strength (kPa) required to reduce the volume of the 100 ml sample of agglomerates (diameter .2 mm) by 10%.
[3]BTU/Lb on air dry basis.
[4]Ash content of feed coal - 22.2% on air dry basis.
[5]Ash content of feed coal - 20.3% on air dry basis.

The embodiments of the invention in which an exclusive property or privilege is claimed are defined as follows:

1. A process for selectively agglomerating coal particles in an aqueous slurry to preferentially collect and agglomerate the coal-rich particles therein and separate the inorganic mineral materials therefrom, which comprises:

providing an aqueous slurry containing low rank sub-bituminous coal particles;

adding an agglomeration agent to the slurry, said agent comprising a bridging liquid and a diluent for said bridging liquid, said bridging liquid being selected from the group consisting of bitumen, heavy oil, and emulsions thereof, said diluent being a light hydrocarbon, said bitumen having a specific gravity in the range 5.5–10°API, said heavy oil having a specific gravity in the range 10–20°API;

the amount of said bridging liquid plus diluent being in the range of 10 to 20% weight to dry ash-free coal weight, the ratio of bridging liquid to diluent being in the range 0.50 to 0.98; and agitating the mixture to form agglomerates of the sub-bituminous coal particles, said agglomerates having a compressive strength in excess of 150 kPa as defined in Table I.

2. The process as set forth in claim 1 wherein:

the diluent is selected from the group consisting of kerosene, naphtha and diesel oil.

3. The process as set forth in claim 2 wherein:

the bridging liquid is bitumen.

4. The process as set forth in claim 1 wherein:

the bridging liquid is bitumen and the diluent is kerosene.

* * * * *